United States Patent [19]

Ohuchi et al.

[11] Patent Number: 4,866,487

[45] Date of Patent: Sep. 12, 1989

[54] IMAGE FORMING APPARATUS

[75] Inventors: Osamu Ohuchi; Takamasa Sawada, both of Kawasaki, Japan

[73] Assignee: Canon Kabushiki Kaisha, Tokyo, Japan

[21] Appl. No.: 289,461

[22] Filed: Dec. 22, 1988

Related U.S. Application Data

[63] Continuation of Ser. No. 847,649, Apr. 3, 1986, abandoned.

[30] Foreign Application Priority Data

Apr. 5, 1985 [JP] Japan ..... 60-072034
Apr. 5, 1985 [JP] Japan ..... 60-072036
Apr. 5, 1985 [JP] Japan ..... 60-072039

[51] Int. Cl.[4] ..... G03G 15/00

[52] U.S. Cl. ..... 355/313; 355/318; 355/322; 355/323; 271/291; 271/902

[58] Field of Search ..... 355/35 H, 145 H; 271/291, 902, 186, 207, 279, 285, 286, 80; 414/54, DIG. 900

[56] References Cited

U.S. PATENT DOCUMENTS 3,994,487 11/1976 Wicklund ..... 271/80
4,334,759 6/1982 Clausing ..... 355/14 SH X
4,553,831 11/1985 Dixon ..... 355/3 SH X
4,607,948 8/1986 Naito ..... 355/14 SH X

FOREIGN PATENT DOCUMENTS 58-224357 12/1983 Japan ..... 355/14 SH
59-12045 1/1984 Japan ..... 414/54

*Primary Examiner*—A. C. Prescott
*Attorney, Agent, or Firm*—Fitzpatrick, Cella, Harper & Scinto

[57] ABSTRACT

An image forming apparatus provided with a mechanism for discharging the sheet which has been image-processed. The sheet supplying station accommodating a cassette or the like and the image forming station containing a photosensitive member or the like are substantially vertically aligned. The apparatus comprises a sheet reversing and discharging mechanism for inverting the face orientation of the sheet and then discharging it. The sheet reversing and discharging mechanism has a sheet switch-back passage which is disposed between the sheet supplying station and the image forming station, the sheet switch-back passage extending substantially horizontally. Additionally, the apparatus includes a device for selectively shifting the discharged sheets so as to form groups of sheets, without disturbing already-formed groups.

21 Claims, 9 Drawing Sheets

IMAGE FORMING APPARATUS

This application is a continuation of application Ser. No. 847,649, filed Apr. 3. 1986, now abandoned.

FIELD OF THE INVENTION AND RELATED ART

The present invention relates to an image forming apparatus such as a copying machine, a printer and a recording machine, more particularly to an image forming apparatus provided with a mechanism for discharging a sheet such as a copy sheet, a printed sheet and a recorded sheet, which has been subjected to image formation process.

In those types of machines, if the sheets are discharged to a discharge tray with its image bearing surface facing up, the sheets are stacked face up in the page order from the bottom, so that the order of pages is not as desired.

In order to avoid this, it has been proposed that the face orientation of the sheets is inverted and the sheet then discharged to the tray. To invert the sheet, it is deflected upwardly or downwardly after passing through an image fixing station. This, however, results in that the sheet passage is considerably extended in the vertical direction so as to increase the machine height, and that the latitude of the position of a cassette which is horizontally movable with respect to the machine, is limited due to the sheet passage. This problem is more remarkable with the increase of the length of the sheet used, since it requires an even longer sheet inverting passage.

When the sheet is discharged and stacked face up, it is convenient on the other hand since the image on the sheet can be immediately checked on the tray after the discharge.

As described above, the corresponding disadvantage is that the page order is opposite to that desired. On the other hand, in order to discharge the sheet face down, the sheet must be inverted at least once before it is discharged. To do this, it is necessary for a sheet reversing guide to turn the sheet, which can curl the sheet if it is rigid as in a post card, thus resulting in inconvenient usage thereof later on.

In those machines, it is convenient that when plural copies are formed from each of different originals, the copy sheets are classified or grouped depending on the originals. To do this, the discharge tray for receiving the discharged sheets are laterally moved to shift it depending on the originals.

However, when the discharge tray is moved, the stacked sheets are vibrated, are deviated or are disturbed. Additionally, the discharge tray usually extends out of the main frame and moves with the result that it can abut other members or operators. The sheets which have passed through the image fixing station, for example, are more or less curled so that it is difficult to align the sheets when the discharge tray is moved to shift the sheet positions.

SUMMARY OF THE INVENTION

Accordingly, it is a principal object of the present invention to provide an image forming apparatus which includes a sheet reversing and discharging mechanism without requiring a large space, so that the size of the machine can be reduced.

It is another object of the present invention to provide an image forming apparatus wherein the sheet can be discharged selectively face up or face down, depending on the material of the sheet, the thickness of the sheet or the state of the image formed on the sheet.

It is a further object of the present invention to provide an image forming apparatus provided with a stable and safe sheet classifying mechanism.

According to an embodiment of the present invention, the image forming apparatus comprises a sheet stacking station for stacking sheets to be fed out and an image forming station for executing an image forming process to the sheet fed from said sheet stacking station, wherein those stations are arranged substantially vertically; and between the sheet stacking station and the image forming station, a sheet switch-back passage constituting a part of a sheet reversing and discharging mechanism for inverting the face orientation of the sheet is extended substantially horizontally. Because of this structure, the size of the image forming apparatus can be reduced.

According to an embodiment of the present invention, a sheet passage can directly discharge the sheet from the image forming station without passing through the sheet reversing mechanism, and therefore, a relatively hard or thick sheet can be smoothly discharged.

According to an embodiment of the present invention, a sheet shifting means for classifying the discharged sheets depending on the proper groups is provided within the sheet switch-back passage, so that the sheet has been already shifted when the sheet is discharged, thus eliminating the tray shifting operation. Therefore deviation of the sheets can be avoided, and therefore, the discharging tray is not required to effect a shifting operation, thus providing a safer device.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
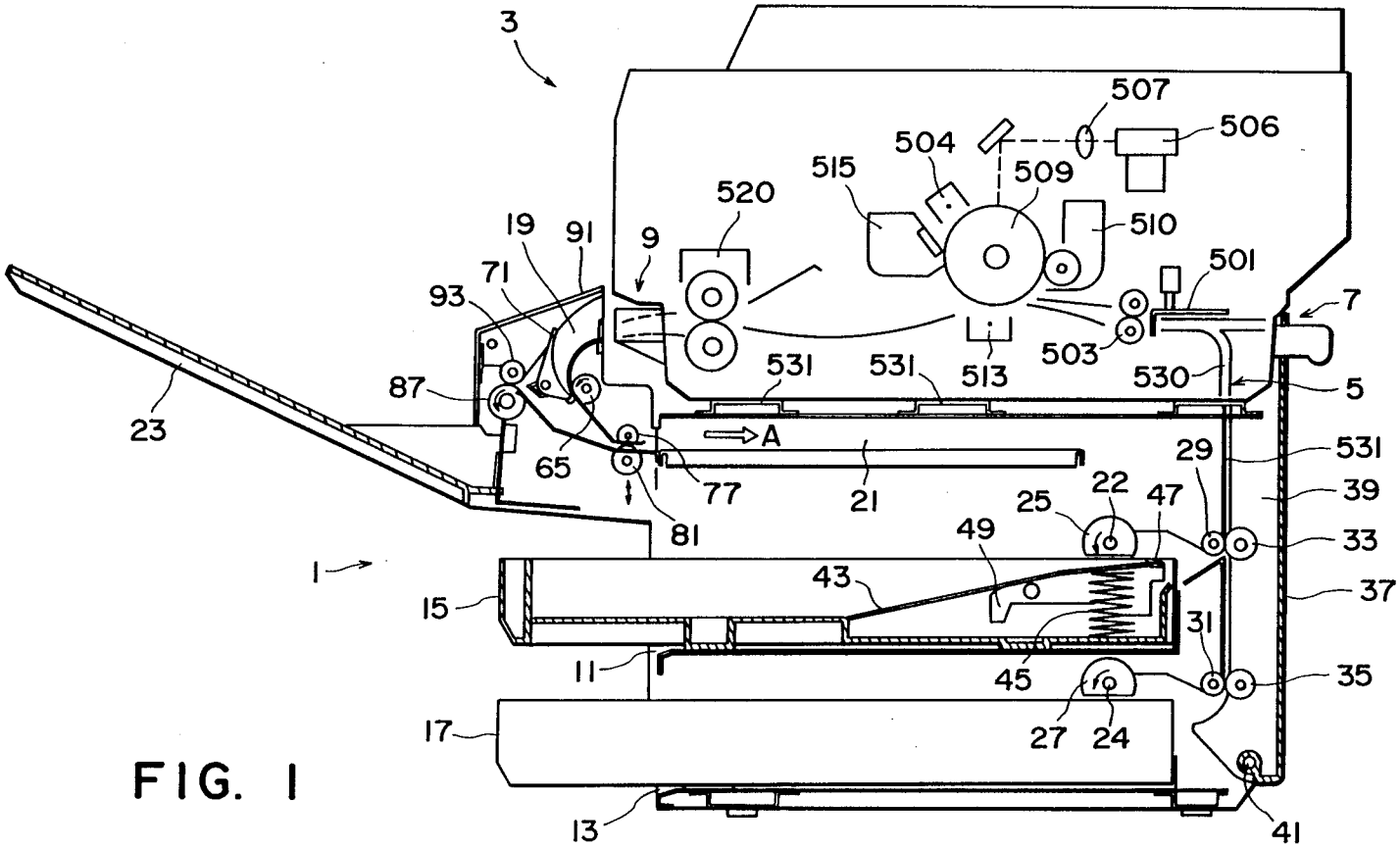
FIG. 1 is a sectional view of a laser beam printer as an example of the image forming apparatus according to an embodiment of the present invention, showing the general arrangement thereof.

Referring to FIG. 1, there is shown an image forming apparatus according to an embodiment of the present invention. In this Figure, the image forming apparatus is shown as a laser beam printer as an example thereof. The laser beam printer receives an image information signal from an unshown image reader or the like and produces a laser beam modulated in accordance with the information signal. A photosensitive member 509 of the laser beam printer is exposed to the laser beam thus produced by way of mirrors and lenses 507 so that the photosensitive member 509 is scanned by the laser beam. On the other hand, a sheet is fed from an automatic feeding station or a manual feeding from the outside of the apparatus, and is once stopped by a registration shutter 501 and then is advanced again at a timing determined by the registration shutter 501 at conveying rollers 503. The sheet receives an image from the photosensitive member 509 by image transfer, and is then passed through a nip formed between image fixing rollers 520. Subsequently, the sheet is advanced to a sheet reversing station, which will be described in detail hereinafter. It is added that a latent image is formed on the photosensitive member 509 in accordance with the image signal and is developed by a developing device 510 into a visible image. After the image transfer to the sheet, the photosensitive member 509 is cleaned by cleaning means 515 such as a cleaning blade so as to be prepared for the next image formation. As will be understood, the photosensitive member 509 is reused.

Those means constitute an image forming station. However, the structures of the image formation is not limited to this.

A sheet conveying device 1 includes a top cassette accommodating portion 11 and a bottom cassette accommodating portion 13 which constitute a sheet supplying station, which is effective to selectively supply the sheet to an automatic supplying aperture 5 from the cassette 15 or 17 loaded in the cassette accommodating portions 11 and 13, respectively. The sheet is discharged from the image forming station through a discharge aperture 9. The discharged sheet having a copied image thereon is guided to a sheet reversing station (a reversing passage) 19, where the sheet is inverted in its face orientation and then is fed to a switch-back station (switch-back passage) 21. At the switch-back station 21, the sheet is switched back without or with shifting in the lateral direction (with respect to the direction of movement of the sheet) and is then discharged onto the discharge tray 23. The sheets, when shifted are accommodated there for each group with the shifts. In this embodiment, the sheet reversing station 19 and the switch-back passage 21 constitute the sheet reversing and discharging mechanism. The structures of the sheet feeding device 1 will be described in more detail. In this embodiment, the sheet feeding device is optional and may be combined with the main assembly of the image forming apparatus 3, and therefore, it is named as the sheet feeding device 1. However, in the case where the feeding device 1 is contained in the main frame 3, it may be as a whole called an image forming apparatus.

The cassette accommodating portions 11 and 13 are provided with feeding rollers 25 and 27, respectively. Each of those rollers 25 and 27 is of a part-circle shape provided by cutting a part of the circle away therefrom. The feeding rollers 25 and 27 are rotatable about shafts 22 and 24, respectively, and are effective to pick up the sheets in the cassettes 15 and 17.

Downstream of the cassette accommodating portions 11 and 17 with respect to advancement of the sheets, there are conveying rollers 29 and 31 driven by a motor, which is effective to supply the sheet fed out of the cassette by urging rollers 33 and 35 and the feeding rollers 25 and 27, to the automatic feeding aperture 5. In this embodiment, the sheet feeding speed for the sheet fed from the bottom cassette accommodating portion 13 is higher than that from the top cassette accommodating portion 11, so that the time required for the sheet to reach the automatic feeding aperture 5 from the top cassette 15 is substantially equal to that of the sheet from the bottom cassette 17. This will be described further in detail hereinafter. The urging rollers 33 and 35 are rotatably mounted between plural ribs 39 of a side cover 37. The side cover 37 is rotatable by a hinge 41 so as to allow the sheet jammed between rollers 29 and 33 or between rollers 31 and 35 to be removed.

Figure 2:
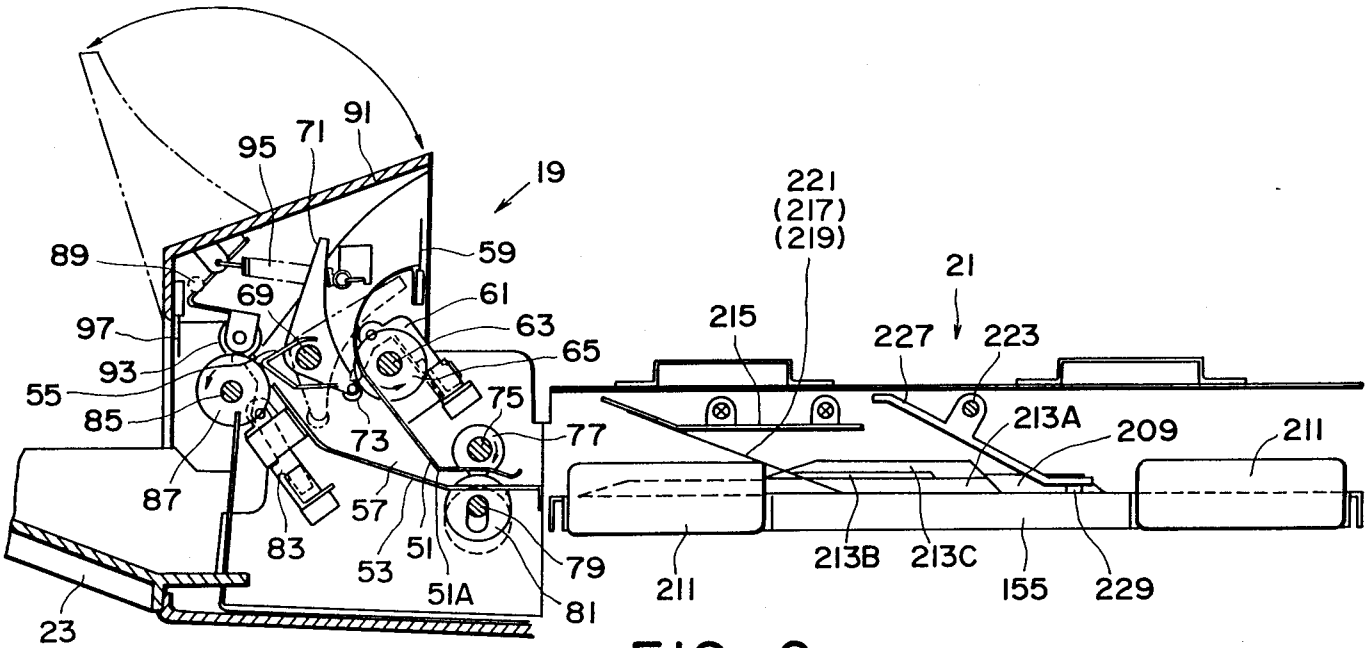
FIG. 2 is a sectional view of a part of the apparatus illustrating a reversing station and switch-back station.

The sheet feeding cassettes 15 and 17, of which the cassette 15 is representative to be shown in detail in the Figure, are each provided with a movable plate 43 for supporting the leading edges of the sheets, a spring 45 for urging the sheets to the feeding or pick-up roller 25 and a couple of separating lever 49 having separation pawls 47 for separating the topmost sheet from the rest. The separating pawls 47 are disposed adjacent the respective lateral ends. The sheet reversing station 19, as shown in FIG. 2 in detail, includes a reversing guide 51, conveying guides 53 and 55. Those means constitute a reversing station or a reversing passage. The reversing guide 51 has a bent portion 51A at a lower position thereof. The bent portion 51A cooperates with the conveying guide 53 to form a space 57 where the trailing edge portions of the sheet can be biased.

Figure 3:
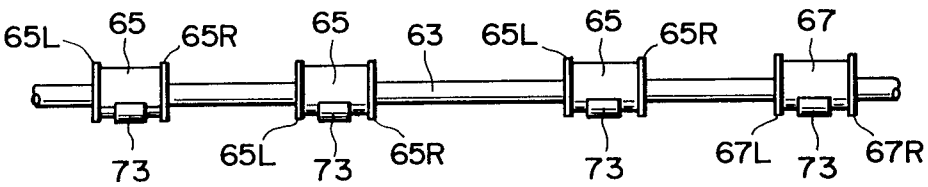
FIG. 3 is a front view of the structure of sheet reversing rollers.

At a top end portions of the reversing guide 51, there is a charge removing or discharging brush 59 mounted thereto. In the middle of the reversing guide 51, there is provided flange rollers 65 and 67, as shown in FIG. 3, mounted to a rotational shaft 63 and there is provided a lever type photosensor 61. The flange roller 65 has a flange 65L at one longitudinal end a flange 65L in the form of a sprocket having a plurality of projections on its circumference. The flange roller 65 has at the other end a flange 65R having a smooth circumferential periphery. The flange roller 67 serving as a conveying rotational member has at the longitudinal ends flanges 67L and 67R having circle peripheries. The flanges 65L, 65R, 67L and 67R constitute an auxiliary conveying rotatable means.

Opposed to the flange rollers 65 and 67, a switching guide 71 is provided which is pivotable about a shaft 69. The switching guide 71 has a rotatable urging roller 73 adjacent a bottom end thereof, which functions as an auxiliary member contactable to the peripheral surfaces of the flange rollers 65 and 67. In this embodiment, the switching guide 71 is in the form of a flapper and serves to selectively convey the sheets discharged from the laser beam printer 3 with or without reversal thereof. As shown in FIG. 2, the switching guide 71 is normally urged by a spring so that a press-contacting roller 73 is urged to the flange rollers 65 and 67. Only when the sheet is to be directly discharged, the shaft 69 is rotated by an unshown lever so that it takes the broken line position. Adjacent a bottom portion of the reversing guide 51, there is a roller 77 mounted to a shaft 75, the roller 77 rotating always in the direction advancing the sheet to the tray. Below the roller 77, a roller 81 is mounted to a shaft 79. The roller 81 is disengaged from the roller 77 when the sheet is to be reversed, and is press-contacted to the roller 77 upon switch-back operation.

Adjacent a front end of the conveying guide 53, there are a lever type photosensor 83 and a discharging roller 87 mounted on a rotational shaft 85. The discharging roller 87 is a roller provided with a flange or flanges as in the above-described flange rollers 65. Above the discharging roller 87, there is a cover mounted by a hinge 89. A press-contacting roller 93 is mounted to the inside of the cover 91 and is contacted to the peripheral of the discharging roller 87. The press-contacting roller 93 is press-contacted to the discharging roller 87 by a spring 95. Further, the cover 91 has a charge removing or discharging brush 97.

The discharge tray 23 is detachably mountable to the reversing station 19.

Figure 5:
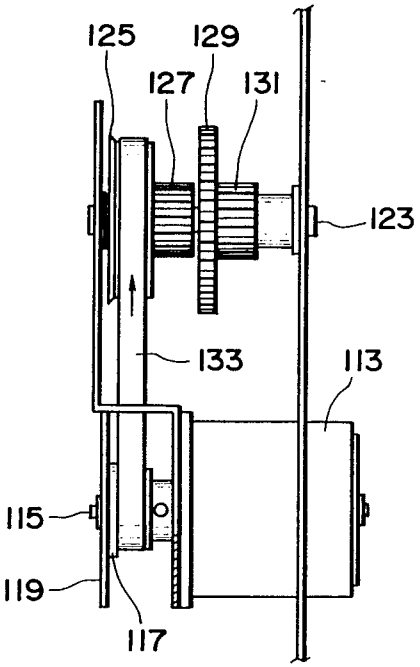
FIGS. 4 and 5 are sectional views illustrating a driving mechanism for the reversing station.
Figure 4:
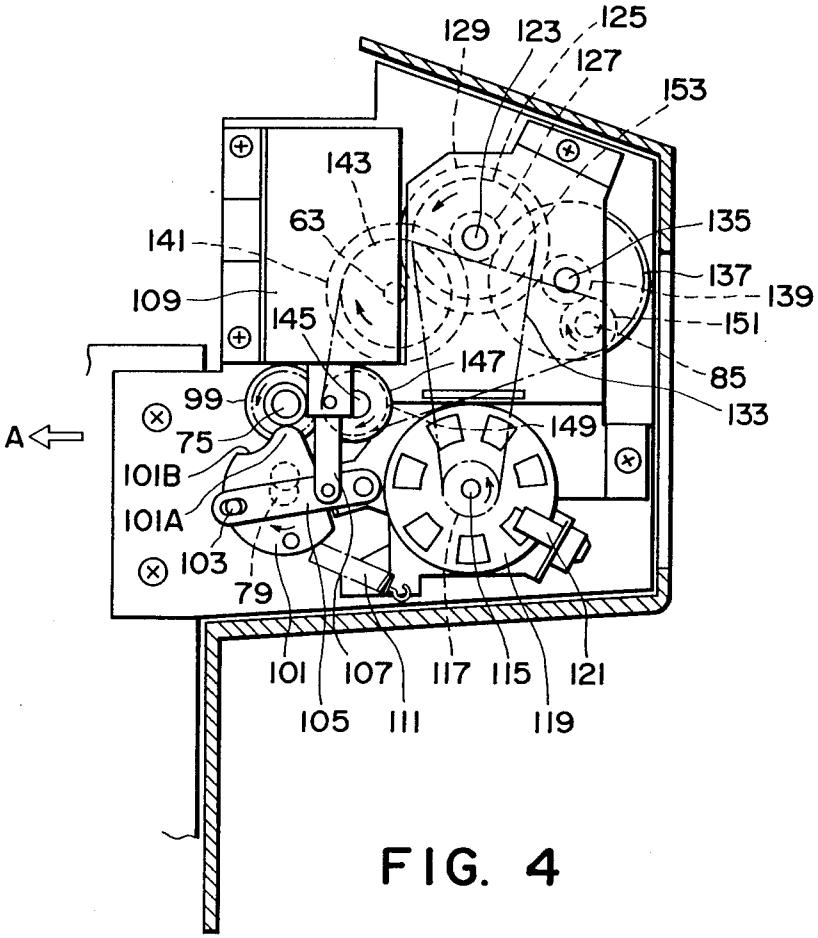

Referring to FIGS. 4 and 5, the driving mechanism for the reversing station will be described. A gear 99 is mounted to an end of the rotational shaft 75. On the other hand, a cam 101 is mounted to an end of the rotational shaft 79. The cam 101 has a projection 101A and a recess 101B. When the projection 101A and the rotational shaft 75 are engaged, the rotational shaft 79 is urged back to move downwardly so that the roller 81 is moved away from the roller 77; whereas when the recess 101B and the rotational shaft 75 are engaged, the rotational shaft 79 moves upwardly so that the roller 81 is urged to the roller 77. At the other end of the shaft 79, a similar cam is mounted so as to move up and down the shaft 79 adjacent the opposite ends thereof.

An arm 105 is mounted to the cam 101 by a pin 103, and the arm 105 are also coupled to a solenoid 109 through an arm 107. The cam 101 is biased by a spring 101 mounted thereto. Therefore, the upward and downward movement of the shaft 79 is effected by rotating the cam 101 by a combination of the attracting force provided by the solenoid 109 and the biasing force provided by the spring 111. This will be described in further detail hereinafter.

To the output shaft 115 of the motor 113, a timing pulley 117 and a clock plate 119 are mounted. The clock plate 119 is interposed between parts of a photointerruptor 121, whereby the number of rotations of the motor 113 can be detected. To the shaft 123, there are mounted a timing pulley 125, a gear 127, 129 and 131. The pulley 125 is operatively coupled with the pulley 117 by a timing belt 133.

To the shaft 135, a gear 137 meshed with the gear 127 and a gear 139 meshed with the gear 129 are mounted integrally, and therefore, the driving force transmitted to the pulley 125 is transmitted in turn to the gears 129 and 131 through the gears 127, 137 and 139. At an end of the rotational shaft 63, a gear 141 meshed with the gear 131 and a timing pulley 143 are mounted. To the shaft 145, a gear 147 meshed with the gear 99 and the timing pulley 149 are mounted. Further, a timing pulley 151 is mounted to the rotational shaft 85. The timing pulleys 143, 149 and 151 are interconnected by a timing belt 153.

In operation, when the motor 113 (FIG. 5) rotates in the counterclockwise direction as seen in FIG. 4, the pulley rotates counterclockwise by the pulley 117 and the belt 133. By this, the gear 144 rotates clockwise by the gears 127, 137, 139, 129 and 131. Therefore, the roller 65 (FIG. 2) rotates, and the pulleys 149 and 151 rotate through the pulley 143 and the belt 153. As a result, the discharging roller 87 rotates, and the gear 99 rotates through the gear 147, and also the roller 77 rotates.

Next, the switch-back station 21 will be described in detail.

As shown in FIG. 2, there is an intermediate tray 155 in the switch-back passage 21. The intermediate tray is disposed between the image processing station (503–520) and the cassette accommodating portion (11 and 13), that is, in the manner that the reversed sheet is stacked above the cassette accommodating portion. This arrangement is effective to reduce the length of the passage for the sheet conveyance. The sheet is stacked on the intermediate tray substantially horizontally. To achieve this arrangement, the image processing station and the cassette accommodating portion are arranged substantially vertically in a substantially superimposed relation. Because of this arrangement, even if the sheet is curled convex-down due to the passage thereof through the image fixing station, the curling is corrected by the sheet reversing operation.

Figure 6:
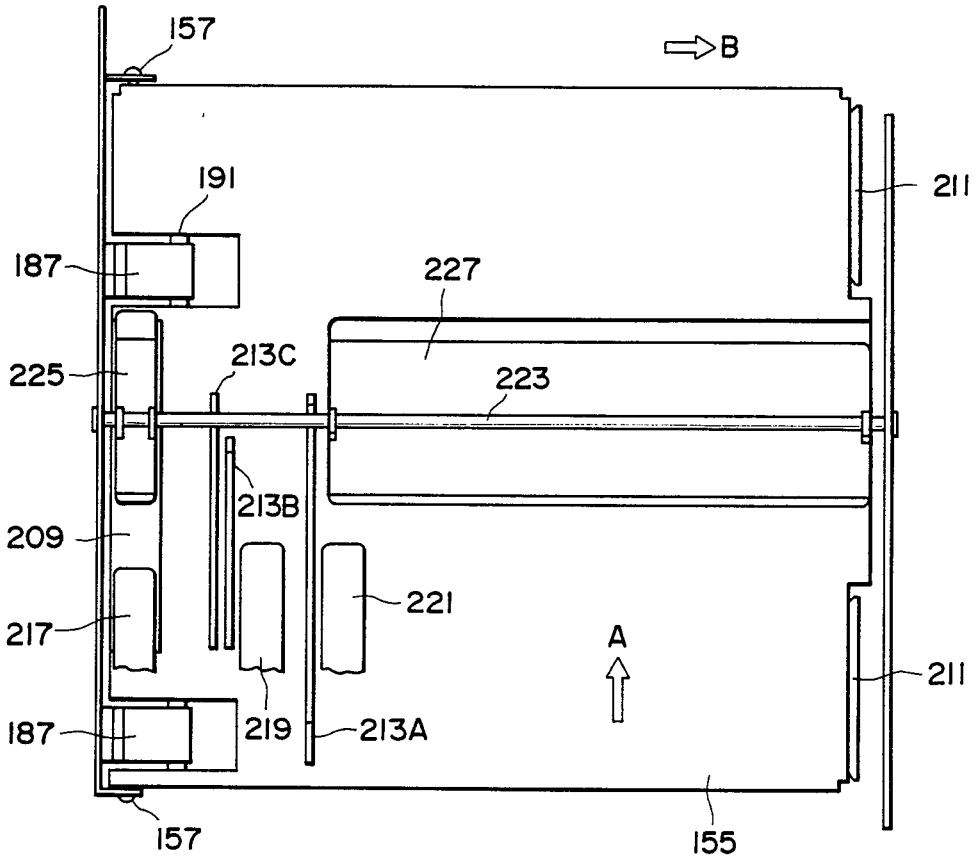
FIGS. 6 and 7 are plan and front views illustrating the structures of an intermediate tray and therearound.
Figure 7:
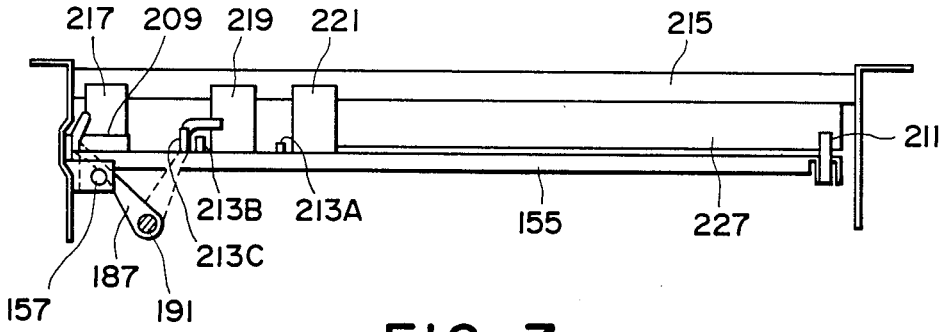
Figure 8:
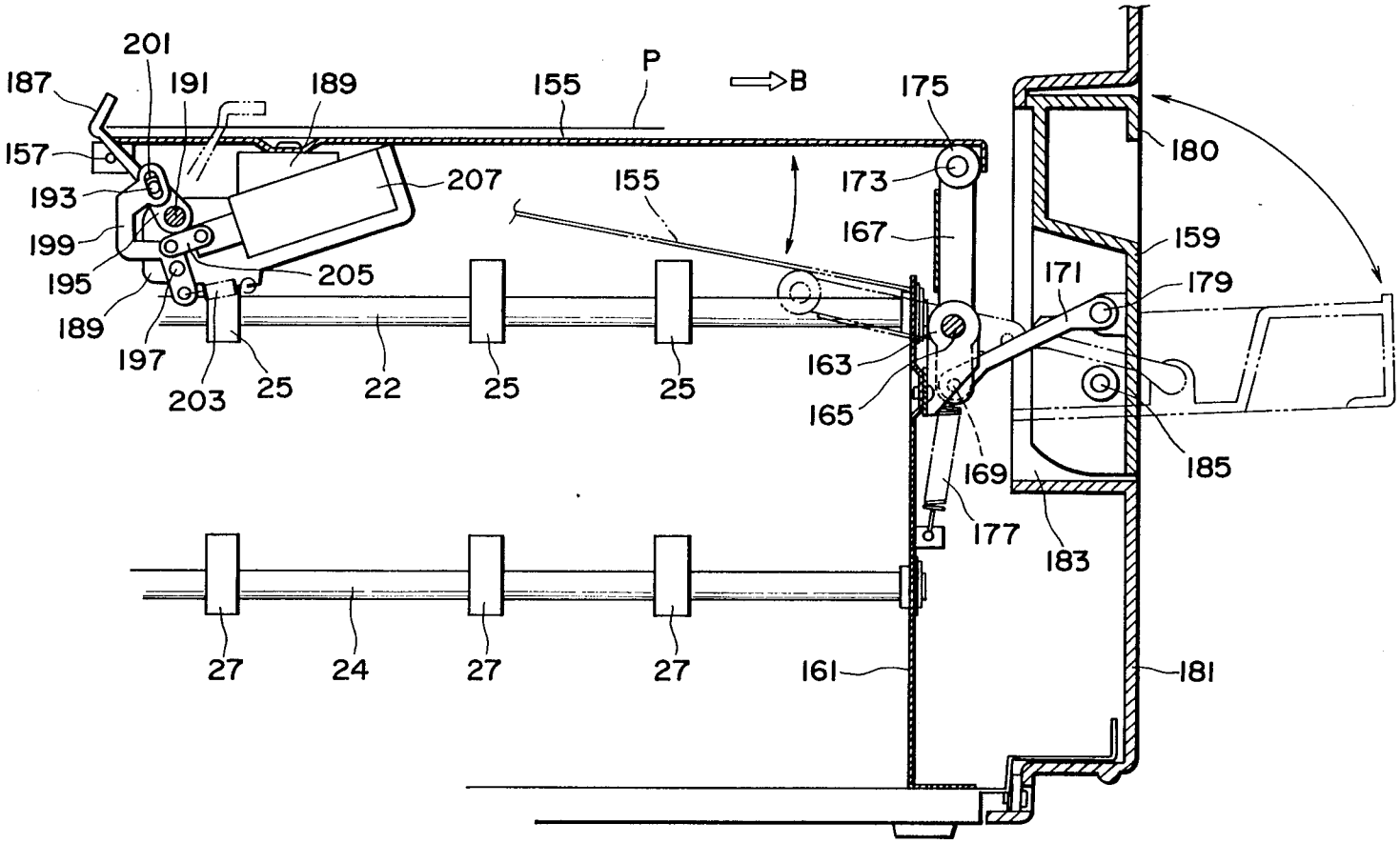
FIG. 8 is a sectional view showing a deflecting lever driving mechanism and an intermediate tray rotating mechanism.

The intermediate tray 155, as shown in FIGS. 6–8, is supported by a hinge one end. The other end thereof is supported in the manner that it inclines when the cover 159 is opened. To accomplish this, a couple of supporting arms 163 is fixed to a frame 161 supporting the rotational shafts 22 and 24, a couple of rotatable arm 167 is mounted through a shaft 165 thereto. Adjacent one of the base ends of the rotational arms 167, a link 171 is mounted through a shaft 169. Adjacent another end, there are provided a rotatable member, a roller 175, for example, contactable to the bottom surface of the intermediate tray 155. Between the shaft 169 and the frame 161, a spring 177 is stretched. The link 171 is mounted to the cover 159 through the shaft 179. The cover 159 has a grip 180 and is openably mounted in the opening 183 of the entire cover 181 by a hinge 185.

On the other hand, at the hinge 157 side, a coupled of deflecting levers 187 is mounted rotatable about a shaft 191 supported on the frame 189. To the shaft 191, as shown in FIG. 8, a link 195 having a pin 193 is mounted. The pin 193 is engaged with an elongate slot 201 formed adjacent an end of an arm 199 rotatable about a shaft 197. Between a base end of the arm 199 and the frame 189, a spring 203 is stretched. The other end portions of the arm 199 is coupled with a solenoid 207 by an arm 205. Therefore, the deflecting lever 187 is rotated by the solenoid 203 and is restored by the spring 203.

On the surface of the intermediate tray 155, as shown in FIGS. 2, 6 and 7, there are provided a sheet supporting (guiding) table 209 adjacent left-hand end, a couple of first stoppers 211 adjacent the right-hand end, and second stoppers 213A, 213B and 213C between the sheet supporting table 209 and the first stopper 211. The stopper 213A is for B5 size (Japanese Industrial Standard); the stopper 213B is for A4 size; and the stopper 213C is for the letter size and the legal size.

Above the intermediate tray 155, as shown in FIGS. 2 and 7, a frame 215 extend laterally. On the frame 215, elastic members or sheets 217, 219 and 211 of synthetic resin material such as polyester resin, as will be seen in FIG. 7. Further, above the intermediate tray 155, as shown in FIG. 6, there is a shaft 223, to which weights 225 and 227 are mounted for individual rotation. Those portions of the weights 225 and 227 which are contactable to the sheet are provided with projection 229.

The description will be made with respect to operation of the sheet conveying device 1. For the purpose of explanation, it is assumed that the cassette 15 contains B5 size sheets, whereas the cassette 17 contains A4 size sheets.

When the solenoid 109 is not energized as shown in FIG. 4, the projection 101A of the cam 101 urges the rotational shaft 75 so that the roller 81 (FIG. 1) is away from the roller 77. Stated another way, there is a space between the roller 77 and the roller 81 to allow passage of the sheet.

Under those conditions, when B5 size sheet feeding instructions are produced, the sheet in the cassette 15 is picked up by the pick-up roller 25, and only one of the sheets is separated from the rest by the separation pawl 47, and the one sheet is gripped by the nip formed by the conveying roller 29 and the press contacting roller 33, and is conveyed to the automatic paper feeding aperture 5 of the laser beam printer 3.

The motor 113 (FIG. 5) rotates to drive the driving mechanism.

The sheet introduced into the laser beam printer 3 receives an image corresponding to the image information, and is discharged through the discharging aperture 9.

The discharged sheet is then electrically discharged, by the charge removing brush 59 shown in FIG. 2, while being conveyed along the inside surface of the switching guide 71 downwardly, and is gripped by the nips formed between the flange rollers 65 and 67 and the press-contacting roller 73. At this time, the lever type photosensor 61 is actuated. The sheet gripped by the nips is formed into a wave form by the flanges 65L, 65R, 67L and 67R, so that the sheet is made rigid. Upon the leading edge of the sheet abutting the conveying guide 53, the sheet bends toward the intermediate tray 155, and advances into the switch-back passage 21, as indicated by an arrow A in FIG. 1. In this state, the sheet discharged through the discharging aperture 19 is already inverted in its facing orientation.

Thereafter, the leading edge of the sheet is conveyed to the intermediate tray 155 while raising the elastic members 217, 219 and 211 and weights 225 and 227. When the trailing edge of the sheet is passed by the press-contacting roller 73, the trailing edge portion of the sheet is discharged by the flanges 65L and 65R of the flange roller 65. Therefore, the sheet is completely away from the press-contacting roller 73 and from the flange roller 65, so that the trailing portion of the sheet rotates about the bent portion 51A of the reversing guide 51 through the space 57 toward the conveying guide 53 by its own weight and rigidity.

On the other hand, when the trailing end of the sheet passes by the lever type photosensor 61, the sensor 61 is rendered off, and then, the solenoid 109 (FIG. 4) is energized a predetermined period after that, and therefore, the cam 101 rotates clockwise through the arms 107 and 105. The recess 101B of the cam 101 comes to engage with a shaft 75, whereby the roller 81 (FIG. 2) is raised to press-contact to the roller 77 through the sheet. By this, the rotation of the roller 77 is transmitted to the roller 81, whereby the sheet is reversed toward the discharging roller 87 along the guide 53. The sheet is then gripped by the nip formed between the discharging roller 87 and the press-contact roller 93. At this point of time, the lever type photosensor 83 is actuated, with the result that the solenoid 109 is deenergized (FIG. 4). Then, the cam 101 rotates counterclockwise by the force of the spring 111, and the recess 101A thereof is engaged with a shaft 75 so as to lower the shaft 79. By this, the roller 81 is disengaged from the roller 77.

The sheet gripped by the nip between the discharging roller 87 and the press-contacting roller 93 is discharged as it is, and therefore, the sheet is stacked on the discharge tray 23 face down, that is, with the image bearing surface facing downwardly.

When the information to be recorded by the laser beam printer 3 consists of plural pages, the same sequential operations are repeated until the last page is recorded.

The description will be made as to the case where plural sets of plural page information are to be obtained.

The operations for obtaining the first set is the same as described above.

Figure 9:
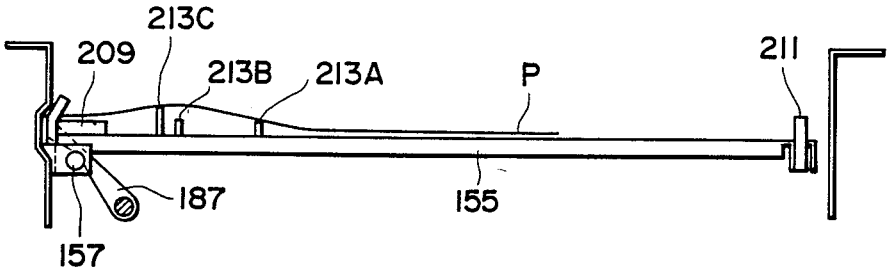
FIGS. 9 and 10 illustrate an embodiment of the sheet shifting means.
Figure 10:
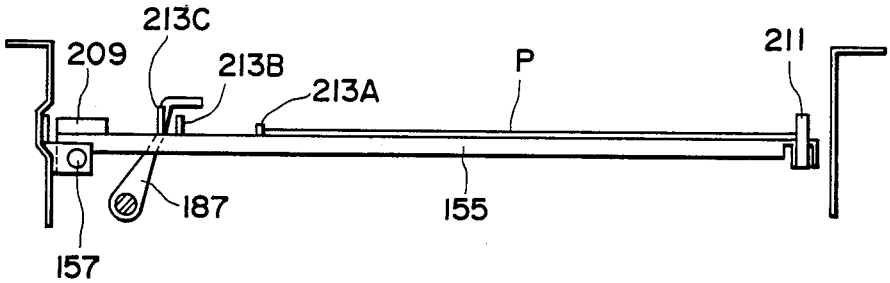

As for the second set recording, the image information read by the image reader and stored, and is transmitted to the printer 3 from the first page, again. The image forming operation is repeated to the sheet. The sheets for the second set are conveyed to the reversing passage 19 as in the case of the first set, and received by the intermediate tray 155 as shown in FIG. 9. When the trailing edge of the sheet is out of the lever of the lever type photosensor 61 so that the sensor 61 is rendered off, the solenoid 207 shown in FIG. 8 is energized for a very short time period after a predetermined period of time has passed therefrom. By this, the deflecting lever 187 rotates to kick the lefthand end of the sheet. Therefore, as shown in FIG. 10, the sheet P shifts laterally on the intermediate tray 155, as shown by an arrow B, with the result that the righthand end of the sheet P abuts the first stopper 211. At this time, the sheet P tends to rebound. However, the elastic member 211 shown in FIG. 7 confines the sheet P, so that the sheet P is confined to the right side of the stopper 213A without its left end beyond the stopper 213A. Thus, the rebounded sheet P is received by the stopper 213A.

On the other hand, after the sensor 61 is rendered off and the sheet P is shifted, more particularly, a predetermined period after the sensor 61 is rendered off, the solenoid 109 as shown in FIG. 4 is energized, thus press-contacting the roller 81 to the roller 77, thus conveying back the sheet P. The sheet discharged by the discharging roller 87 and the press-contacting roller 93 is accommodated on the discharge tray 23 with the shift laterally, more particularly, shifted toward the operator. By repetition of the operation, the copying and sheet conveying for the second set are effected continuously. The sheet conveyance for the third set is the same as in the case of the first set.

Figure 11:
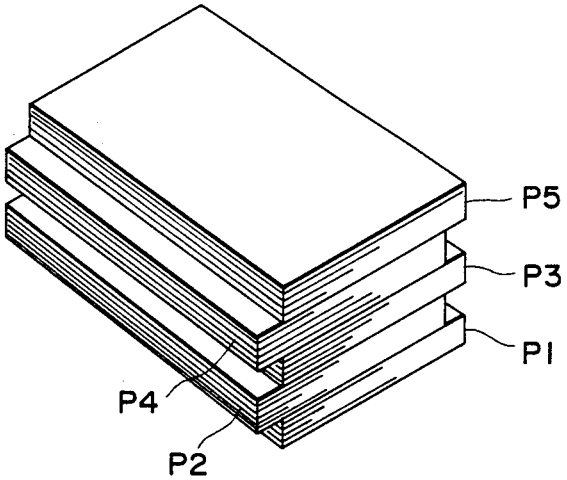
FIG. 11 is a perspective view showing the sheets shifted.

In this manner, as shown in FIG. 11, the discharge tray 23 accommodates the odd number groups P1, P3, P5, P7, . . . and the even number groups P2, P4, P6, P8, . . . , which are alternately shifted thereon.

In the case where plural sets of plural page information are to be recorded on the A4 size sheets accommodated in the cassette 17, the similar operation is effected, with the exception that the sheet fed out by the feeding roller 27 is conveyed to the automatic feeding outlet 25 at a speed higher than that fed out of the feeding roller 25. Additionally, the sheet which is conveyed to the intermediate tray 155; is kicked by the deflecting lever 187; and rebounded by the first stopper 211, is received by the second stopper 213B.

The sheets are conveyed in the manner described above and received by the discharge tray 23 with the groups shifted, irrespective of the sizes of the sheets. When a sheet is jammed in the reversing station 19, the cover 91 is opened by rotating it about a hinge 89, as shown by chain lines in FIG. 2 so as to allow disposal of the jammed sheet.

On the other hand, when it is not necessary to reverse the copied sheet or to classify the copied sheets, the switching guide 71 is rotated as shown by broken lines in FIG. 2 by an unshown lever, so that the sheet is discharged as it is. More particularly, after the image is transferred onto the sheet, the sheet is passed through the image fixing device 16, and subsequently, it is discharged onto the discharge tray 23 face up, through the discharging roller 87 because the flapper 71 takes the position to do this, by a plunger or the like.

The sheet guide (sheet transportation passage) is formed substantially rectilinearly from the image fixing device 520 in the direction of the sheet transportation, and therefore, the sheet is discharged onto the discharge tray 23 through the discharging roller 87 in substantially a straight line.

When the sheet is jammed in the switch-back station 21, the cover 159 is manually rotated by the grip to rotate it outwardly about the hinge 185, as shown in FIG. 8. By this, the rotatable arm 167 rotates counterclockwise about the shaft 165 together with the cover 159 rotation through the link 171. Therefore, the roller 175 supporting the right end portion of the intermediate tray 155 lowers while rolling on the back surface of the intermediate tray 155. Thus, the intermediate tray 155 rotates downwardly about the hinge 157 so as to incline toward the cover 159. Because of this, the switch-back station 21 is widely opened so as to allow the operator to dispose of the jammed sheet.

Figure 12:
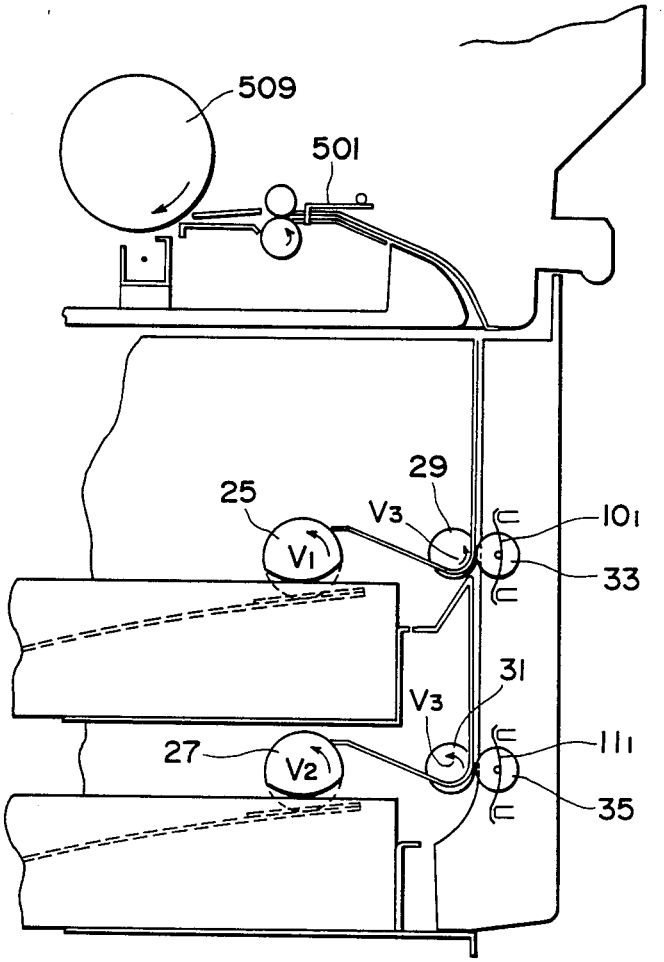
FIG. 12 is an enlarged sectional view of a sheet feeding station.

Referring to FIG. 12, the description will be made with respect to the sheet feeding speed by the feeding rollers 25 and 27. The sheet picked up from the top cassette 15 or from the bottom cassette 17 by the pick-up roller 25 or 27, is advanced by the conveying rollers 31 and 35 or 29 and 33, until the leading edge of the sheet abuts the registration shutter 501 disposed across the conveying passage, and the sheet is stopped thereby. By this time, that is, when the leading edge of the sheet abuts the registration shutter 501, the trailing edge of the sheet has passed through the feeding roller 25 or 27. And, since the press-contacting roller 33 or 35 is press-contacted to the conveying roller 29 or 31 by the urging spring 101 or 111 under such a proper pressure that the roller slips on the sheets so as to maintain the sheet at the position where its leading edge is at the registration shutter 501. The feeding speeds are different between the feeding rollers 25 and 27 and between the conveying rollers 29 and 31, so that the time required for the leading edge of the sheet abuts the registration shutter 501 from the start of the sheet feeding out of the top cassette 15 is equal to the time required for the leading edge of the sheet to abut the registration shutter 501 from the start of the sheet feeding out of the bottom cassette 17. Each of the feeding rollers 25 and 27 includes a crescent roller which is controlled by a one rotation clutch so as to feed out one sheet by its one rotation.

The above-mentioned time for the top cassette 15 is:

$$(L_1/V_1)+(L_3/V_3)$$

The above-mentioned time for the bottom cassette is:

$$(L_2/V_2)+(L_4/V_4)$$

where $L_1$ is the distance through which the sheet is advanced by the top feeding roller 25, that is, the distance from the roller 25 to the roller 29;

$V_1$ is the conveying speed by the top feeding roller 25;

$L_3$ is the length of the sheet passage after the sheet is discharged from the top feeding roller 25, that is, the distance from the roller 29 to the registration shutter 501;

$L_2$ is the distance through which the sheet is advanced by the bottom feeding roller 27, that is, the distance from the roller 27 to the roller 31;

$V_2$ is the conveying speed of the bottom feeding roller 27;

$L_4$ is the length of the sheet passage after the sheet is discharged from the bottom feeding roller 27, that is, the distance from the roller 31 to the registration shutter 501; and $V_3$ is the sheet conveying speed of the top and bottom feeding rollers 29 and 31.

In order that those time periods are the same, the following is satisfied:

$$(L_1/V_1)+(L_3/V_3)=(L_2/V_2)+(L_4/V_3)$$

This relationship may be satisfied by suitably selecting the number of teeth of the driving gears for each of the rollers, the number of teeth of the timing belt and the distance between the rotational axes thereof.

Figure 13:
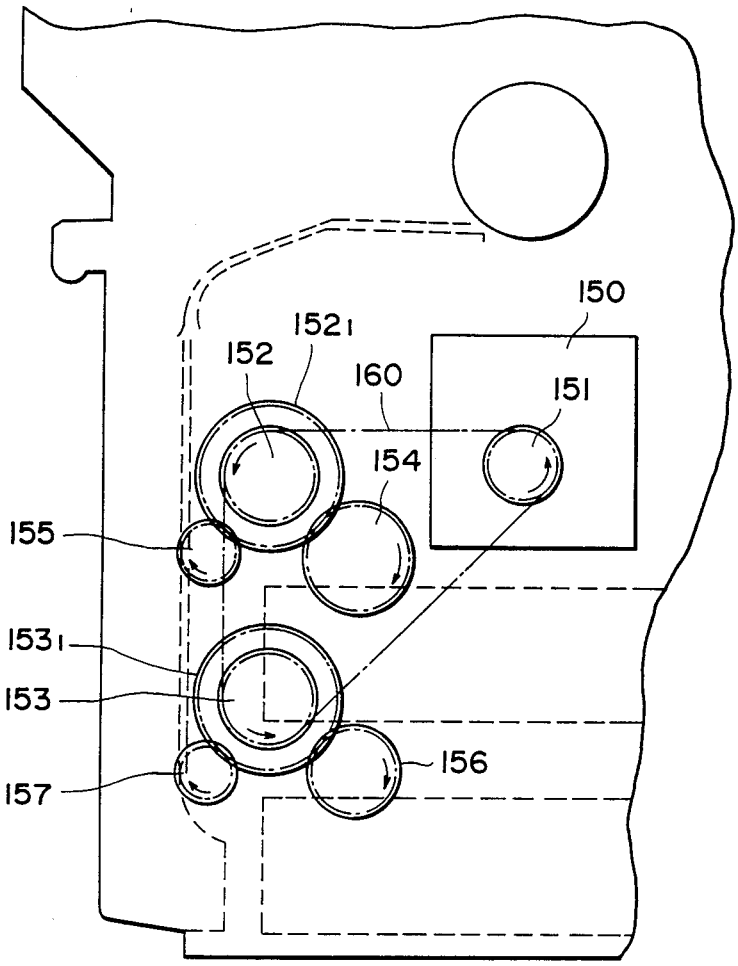
FIG. 13 is a sectional view showing a driving mechanism for the sheet feeding station of FIG. 12.

FIG. 13 is a sectional view illustrating the driving mechanism for the sheet feeding station of FIG. 12. As will be understood, the driving force produced by the driving source 150 (motor) is transmitted from the output gear 151 thereof through a timing belt 160 to idler gears 152 and 153, from which the driving force is transmitted to a top feeding roller gear 154, a top conveying roller gear 155, a bottom feeding roller gear 156 and bottom conveying roller gear 157 by the meshing engagement between a gear $152_1$ and 154 and 155 and between gears $153_1$ and 156 and 157. Those gears, timing belts and the distances between axes are suitably selected so as to satisfy the above-described relationship.

Figure 14:
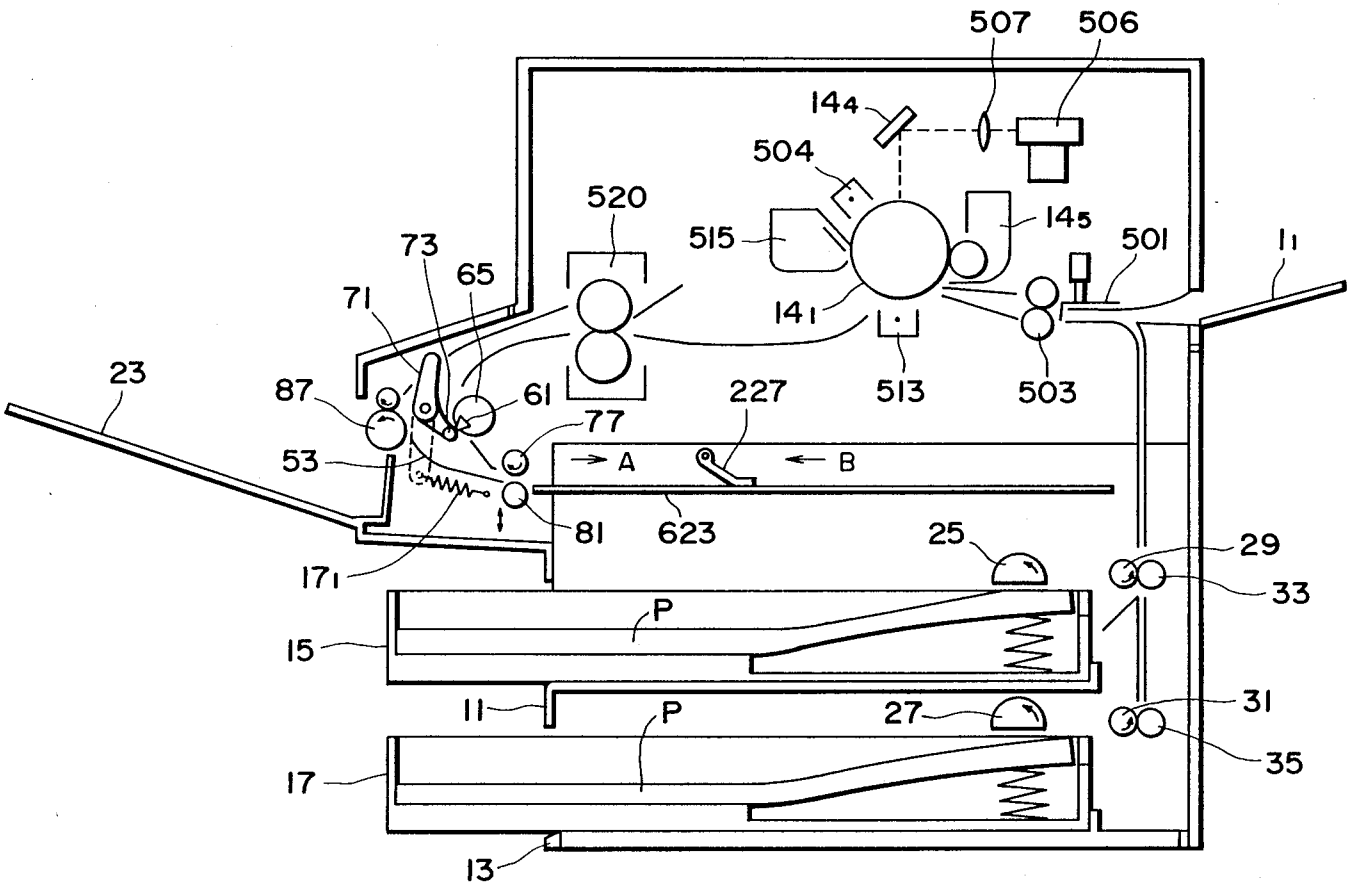
FIG. 14 is a front sectional view of an apparatus according to another embodiment of the present invention, embodied in a laser beam printer.

FIG. 14 illustrates a further embodiment of the present invention, wherein the same reference numerals are assigned to the corresponding means for elements, and therefore, detailed description thereof is omitted for the sake of simplicity.

In this embodiment, a weight is rotatably supported adjacent the center of the intermediate tray 623. The weight 623 is rotatable by its own weight to contact the intermediate tray 623 adjacent the center thereof. The weight 227 serves to prevent the sheet stacked thereon from rising from the tray 623. The top surface of the tray 623 is shaped into a waveform. The above-described weight 227 is effective to wave the stacked sheet along the waveform of the intermediate tray 623. The sheet which can be curled convex down when passing through the image fixing device is reversed downwardly in the shape of U so as to remove or reduce the curling. Further, in order to reduce the length of the sheet conveying passage, the intermediate tray is disposed between the image processing station and the cassette accommodating portion, more particularly, the sheet discharged from the image processing station is reversed in the form of U and is received by the intermediate tray right above the cassette accommodating portion.

In this embodiment, at least the bottom portion of the intermediate tray 623 is of transparent material, and therefore, when the top and bottom cassettes are removed for the purpose of jam disposal, the jam in the intermediate tray 623 is simultaneously observed.

The sheet stacked on the intermediate tray 623 is conveyed in the direction indicated by an arrow Y, and it reaches the discharging roller 87. At this time, the upper and bottom follower rollers 81 lower at predetermined period after that, so that the driving force of the driving roller 77 does not act on the sheet. The sheet conveying speeds of the roller 77 and the roller 87 at this time are so determined that when a short sheet is reversed while a long sheet is transported, those sheets are not superimposed, more particularly, so as not to avoid that the trailing end portions of the long sheet is superposed with the leading edge portions of the short sheet.

A relatively rigid sheet, such as post cart, can be manually fed from the manual feeding table $1_1$. The sheet is inserted as far as its leading edge abuts the registration shutter 501.

As described in the foregoing embodiment, the intermediate tray, the top cassette 15 and/or the bottom cassette 17 are arranged in parallel lines substantially at the same horizontal position, whereby the maintenance operation is made easier, for example, the disposal of the jam.

The sheet bearing an unfixed image on its top surface is passed through the nip of the fixing device 520 formed by a top rigid roller and a bottom elastic roller. In this case, the sheet can be discharged therefrom convex down due to the elasticity of the bottom roller. In the embodiment described above, the sheet turns downwardly for reversal and stacked on the intermediate tray 623, and therefore, the curling resulting from the fixing device 520 can be corrected.

Furthermore, the sheet can be reversed immediately after the fixing device 520 and is introduced onto the stacking tray 623, and therefore, the length of the passage from the sheet can be reduced remarkably.

When the sheet is jammed in the apparatus, the operator usually checks after unloading the cassette. At this time, according to this embodiment, the operator can easily confirm the jam on the intermediate tray, simultaneously.

In the last embodiment, the whole or bottom part of the intermediate tray 623 is of transparent material. However, it is a possible alternative that it is constructed by wires or net, since then the state of jam can also be easily confirmed. Also, it is possible that the intermediate tray is constituted by a top cover for the cassette.

While the invention has been described with reference to the structures disclosed herein, it is not confined to the details set forth and this application is intended to cover such modifications or changes as may come within the purposes of the improvements or the scope of the following claims.

What is claimed:

1. An image forming apparatus, comprising:

sheet feeding means for feeding sheets;

image forming means for forming image on the sheets fed by said sheet feeding means;

a sheet guiding message for guiding the sheet through said image forming means from an upstream side of said image forming means to a downstream side thereof;

means for applying image information signal to said image forming means;

sheet discharging means for discharging the sheets on which the images are formed by said image forming means;

stacking means for stacking the sheets discharged by said discharging means;

inverting means for inverting in facing orientation the sheets on which the images are formed, said inverting means being disposed upstream of said discharging means; and shifting means for laterally shifting, in said inverting means, the sheets to stack the sheets on said stacking means at one of predetermined different lateral positions.

2. An apparatus according to claim 1, wherein said shifting means shifts the sheets so that the discharged sheets are stacked at a first position or a second position shifted by a predetermined amount from the first position.

3. An apparatus according to claim 1, wherein said inverting means includes a U-shaped guide for inverting the sheets and a switching back passage for receiving the sheets from the U-shaped guide.

4. An apparatus according to claim 3, wherein said feeding means, said switching back passage and said image forming means are arranged vertically.

5. An apparatus according to claim 3, wherein said shifting means shifts the sheets in the switching back passage.

6. An apparatus according to claim 5, further comprising means for conveying in an opposite direction the sheets which have been laterally shifted or not shifted.

7. An apparatus according to claim 6, wherein said conveying means includes a couple of conveying rollers which are spaced apart when the sheets are guided into the switching back passage and which are urged relative to each other when the sheets are conveyed in the opposite direction.

8. An apparatus according to claim 6, wherein said discharging means discharges the sheets at a speed higher than said conveying means.

9. An image forming apparatus, comprising:

sheet feeding means for feeding sheets;

image forming means for forming images on the sheets fed by said sheet feeding means;

a sheet guiding passage for guiding the sheet through said image forming means from an upstream side of said image forming means to a downstream side thereof;

means for applying image information signal to said image forming means;

sheet discharging means for discharging the sheets on which the images are formed by said image forming means;

stacking means for stacking the sheets discharged by said discharging means;

a first guiding passage for guiding the sheets to stack, face up on said stacking means, the sheets discharged by said discharging means;

a second guiding passage for guiding the sheets to stack, face down on said stacking means, the sheets discharged by said discharging means;

switching means for selectively directing the sheets on which the image is formed by said image forming means, to the first or second passage; and shifting means for laterally shifting, in said second passage, the sheet to stack the sheets on said stacking means at one of predetermined different lateral positions.

10. An apparatus according to claim 9, wherein said shifting means shifts the sheets so that the discharged sheets are stacked at a first position or a second position shifted by a predetermined amount from the first position.

11. An apparatus according to claim 9, wherein said second guiding passage includes a U-shaped guide for inverting the sheets in the facing orientation and a switching back passage for receiving the sheets from the U-shaped guide.

12. An apparatus according to claim 11, wherein said feeding means, said switching back passage and said image forming means are arranged vertically.

13. An apparatus according to claim 9, wherein said shifting means shifts the sheets laterally in said second passage.

14. An apparatus according to claim 11, wherein said shifting means shifts the sheets in the switching back passage.

15. An apparatus according to claim 14, further comprising means for conveying in an opposite direction the sheets having been guided in said switching back passage.

16. An apparatus according to claim 15, wherein said conveying means includes a couple of conveying rollers which are spaced apart when the sheets are guided into the switching back passage and which are urged relative to each other when the sheets are conveyed in the opposite direction.

17. An apparatus according to claim 15, wherein said discharging means discharges the sheets at a speed higher than said conveying means.

18. An image forming apparatus, comprising:

sheet feeding means for feeding sheets;

image forming means for forming images on the sheets fed by said sheet feeding means;

a sheet guiding passage for guiding the sheet through said image forming means from an upstream side of said image forming means to a downstream side thereof;

means for applying image information signal to said image forming means;

switching back means for switching back in feeding orientation the sheets on which the images are formed;

sheet discharging means for discharging the sheets switch backed;

stacking means for stacking the sheets discharged by said discharging means; and shifting means for laterally shifting, in said switching back means, the sheets to stack the sheets on said stacking means at one of predetermined different lateral positions.

19. An image forming apparatus, comprising:

sheet feeding means for feeding sheets;

image forming means for forming images on the sheets fed by said sheet feeding means;

a sheet guiding passage for guiding the sheet through said image forming means from an upstream side of said image forming means to a downstream side thereof;

means for applying image information signal to said image forming means;

switching back means for switching back in feeding orientation the sheets on which the images are formed;

stacking means for stacking the sheets switch backed by said switching back means; and shifting means for laterally shifting, in said switching back means, the sheets to stack the sheets on said stacking means at one of predetermined different lateral positions.

20. An image forming apparatus, comprising:

sheet feeding means for feeding sheets;

image forming means for forming images on the sheets fed by said sheet feeding means;

a sheet guiding passage for guiding the sheet through said image forming means from an upstream side of said image forming means to a downstream side thereof;

means for applying image information signal to said image forming means;

sheet discharging means for discharging the sheets on which the images are formed by said image forming means;

stacking means for stacking the sheets discharged by said discharging means; and shifting means for laterally shifting by tapping an edge of the sheet the sheets to stack the sheets on said stacking means at one of predetermined different lateral positions, said means being disposed upstream of said discharging means.

21. An image forming apparatus, comprising:

sheet feeding means for feeding sheets;

image forming means for forming images on the sheets fed by said sheet feeding means;

a sheet guiding passage for guiding the sheet through said image forming means from an upstream side of said image forming means to a downstream side thereof;

means for applying image information signal to said image forming means;

stacking means for stacking the sheets on which the images are formed by said image forming means; and shifting means for laterally shifting by tapping an edge of the sheet the sheets to stack the sheets on said stacking means at one of predetermined different lateral position, said shifting means being disposed upstream of said stacking means.

* * * * *